US010096287B2

(12) United States Patent
Sung et al.

(10) Patent No.: US 10,096,287 B2
(45) Date of Patent: Oct. 9, 2018

(54) DISPLAY DEVICE AND METHOD OF CONTROLLING THE SAME

(71) Applicant: SAMSUNG DISPLAY CO., LTD., Yongin-si, Gyeonggi-do (KR)

(72) Inventors: Eun Jin Sung, Yongin-si (KR); Jong In Baek, Yongin-si (KR); Ji Young Moon, Yongin-si (KR); Il Nam Kim, Yongin-si (KR); Won Sang Park, Yongin-si (KR); Byeong Hee Won, Yongin-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 191 days.

(21) Appl. No.: 15/157,575

(22) Filed: May 18, 2016

(65) Prior Publication Data

US 2017/0110059 A1 Apr. 20, 2017

(30) Foreign Application Priority Data

Oct. 16, 2015 (KR) ..... 10-2015-0144840

(51) Int. Cl.
*G09G 5/10* (2006.01)
*G09G 3/3275* (2016.01)

(52) U.S. Cl.
CPC ... *G09G 3/3275* (2013.01); *G09G 2320/0626* (2013.01); *G09G 2360/141* (2013.01); *G09G 2360/144* (2013.01)

(58) Field of Classification Search
CPC ..... G09G 2320/0626; G09G 2360/141; G09G 2360/144
See application file for complete search history.

(56) References Cited

U.S. PATENT DOCUMENTS

| | | | | |
|---|---|---|---|---|
| 6,977,642 | B2 | 12/2005 | Nagatani | |
| 2013/0169543 | A1 | 7/2013 | Xia | |
| 2013/0222354 | A1* | 8/2013 | Koivunen | G09G 3/3611 345/207 |

FOREIGN PATENT DOCUMENTS

| | | | |
|---|---|---|---|
| KR | 10-0787030 | B1 | 12/2007 |
| KR | 10-0815006 | B1 | 3/2008 |

* cited by examiner

*Primary Examiner* — Jonathan Boyd
(74) *Attorney, Agent, or Firm* — Lee & Morse P.C.

(57) ABSTRACT

A display device includes a display panel including a plurality of pixels, an illuminance sensor to measure illuminance, and a display controller which includes a processor a brightness controllers. The processor calculates an external illuminance value with reference to a signal from the illuminance sensor. The brightness controller turns off at least one of the pixels and controls the brightness of the display panel when the calculated external illuminance value is in a first region. The first region may be, for example, in a mesopic region.

14 Claims, 5 Drawing Sheets

DISPLAY DEVICE AND METHOD OF CONTROLLING THE SAME

CROSS-REFERENCE TO RELATED APPLICATION

Korean Patent Application No. 10-2015-0144840, filed on Oct. 16, 2015, and entitled, "Display Device and Method of Controlling the Same," is incorporated by reference herein in its entirety.

BACKGROUND

1. Field

One or more embodiments described herein relate to a display device and a method for controlling a display device.

2. Description of the Related Art

A variety of displays have been developed. Examples include liquid crystal displays, organic light emitting diode displays, and an active matrix organic light emitting diode displays. These displays are used in many types of portable electronics, not the least of which include mobile telephones, laptop computers, and tablet personal computers (which may collectively be referred to as mobile terminals).

The picture quality of a display may be based, in part, on screen brightness. One type of display has fixed screen brightness or screen brightness controlled by a user. When a display has a fixed screen brightness, power consumption is unnecessarily large when external illuminance is high. Also, higher screen brightness may not be obtained in a dark environment. For example, since the luminance of day and night environments and sunny and cloudy environments are different, the screen brightness of the display may be different from the brightness that exists around the display. This may cause the eyes of a user to become fatigued.

When screen brightness is automatically controlled in accordance with external illuminance, the user may have a better viewing experience and power consumption may be reduced. However, improvements remain a goal of system designers.

SUMMARY

In accordance with one or more embodiments, a display device includes a display panel including a plurality of pixels; an illuminance sensor to measure illuminance; and a display controller including a processor to calculate an external illuminance value with reference to a signal from the illuminance sensor and a brightness controller to turn off at least one of the pixels and to control brightness of the display panel when the calculated external illuminance value is in a first region. The first region may be in a mesopic region.

The brightness controller may control on and off states of each of the pixels so that a ratio of a number of turned on pixels to a number of all pixels in the display panel is a predetermined value when the external illuminance value is in the first region. The brightness controller may control at least one of the pixels to be turned off when the external illuminance value is in the first region and is to control on and off states of the pixels to reduce a ratio of a number of turned on pixels to a number of all pixels in the display panel as the external illuminance value decreases.

The pixels may include first pixels, second pixels, and third pixels to emit light components of different colors, and a ratio of a number of turned on first pixels to a number of all first pixels in the display panel, a ratio of a number of turned on second pixels to a number of all second pixels in the display panel, and a ratio of a number of turned on third pixels to a number of all third pixels in the panel are substantially equal.

The pixels may include first pixels to emit light components of a first color, second pixels to emit light components of a second color, and third pixels to emit light components of a third color, and the brightness controller may perform control so that a ratio of pixels with respect to a color with lowest emission brightness is highest among a ratio of the number of turned on first pixels to the number of all first pixels in the display panel, a ratio of the number of turned on second pixels to the number of all second pixels in the display panel, and a ratio of the number of turned on third pixels to the number of all third pixels in the display panel. The first color, the second color, and the third color may be respectively red, blue, and green, and a ratio of the number of turned on third pixels to the number of all third pixels in the display panel may be highest.

In accordance with one or more other embodiments, a method for controlling a display device includes measuring illuminance using an illuminance sensor; calculating an external illuminance value with reference to a signal from the illuminance sensor; determining whether the external illuminance value is in a first region; and turning off at least one of a plurality of pixels in a display panel to control brightness of the display panel when the external illuminance value is in the first region. The first region may be in a mesopic region.

Controlling the brightness of the display panel may be performed by controlling on and off states of each of the pixels so that a ratio of a number of turned on pixels to a number of all pixels in the display panel is a predetermined value. Controlling the brightness of the display panel may be performed by controlling at least one of the plurality of pixels to be turned off when the external illuminance value is in the first region and controlling on and off states of the pixels to reduce a ratio of a number of turned on pixels to a number of all pixels in the display panel as the external illuminance value decreases.

The pixels may include first pixels, second pixels, and third pixels to emit light components of different colors of light, and a ratio of a number of turned on first pixels to a number of all first pixels in the display panel, a ratio of a number of turned on second pixels to a number of all second pixels in the display panel, and a ratio of a number of turned on third pixels to a number of all third pixels in the display panel may be substantially equal.

In accordance with one or more other embodiments, an apparatus includes a processor to calculate an external illuminance value with reference to a signal from an illuminance sensor; and a brightness controller to turn off at least one of a plurality of pixels to control brightness of a display when the external illuminance value is in a first region. The first region may be in a mesopic region. The brightness controller may control on and off states of each of the pixels so that a ratio of a number of turned on pixels to a number of all pixels in the display panel is a predetermined value when the external illuminance value is in the first region.

The brightness controller may control at least one of the pixels to be turned off when the external illuminance value is in the first region and is to control on and off states of the pixels to reduce a ratio of a number of turned on pixels to a number of all pixels in the display panel as the external illuminance value decreases.

The pixels may include first pixels, second pixels, and third pixels to emit light components of different colors, and a ratio of a number of turned on first pixels to a number of all first pixels in the display panel, a ratio of a number of turned on second pixels to a number of all second pixels in the display panel, and a ratio of a number of turned on third pixels to a number of all third pixels in the display panel may be substantially equal.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
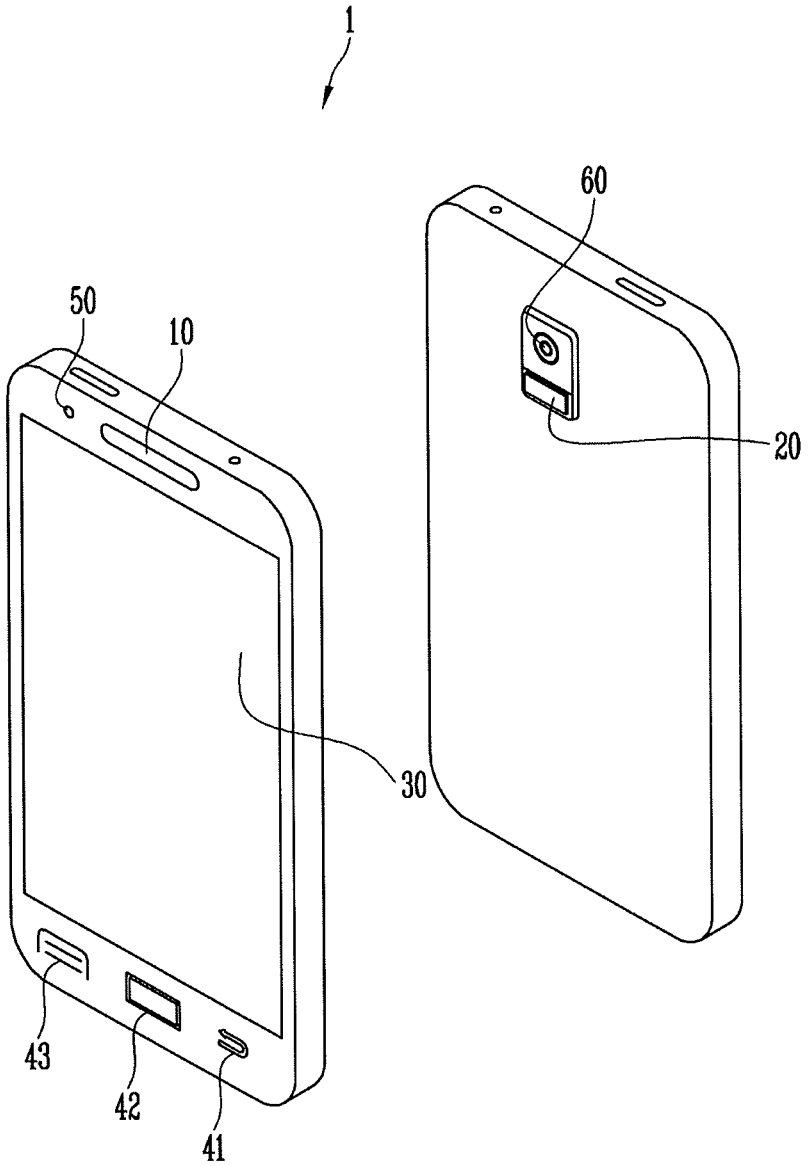
FIG. 1 illustrates the external appearance of an embodiment of a display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an embodiment of the external appearance of a display device 1 which includes a display panel 30 on and fastened to a front surface of a main body. One or more additional devices are formed around the display panel 30 to perform predetermined functions. The additional devices at an upper end of the display panel 30 may include a speaker 10 for outputting an audio signal and an illuminance sensor 50 capable of measuring external brightness (e.g., illuminance). The additional devices at a lower end of the display panel 30 may include a plurality of function keys, e.g., a cancel key 41, a home key 42, and a menu key 43.

Referring to FIG. 1, a camera 60 and a light emitting diode (LED) 20 for providing a flash function may on a rear surface of the display device 1. A camera may be also provided on the front surface of the display device 1 on which the display panel 30 is arranged. The display device 1 may also include a gyro sensor, an acceleration sensor, a terrestrial magnetism sensor, a fingerprint sensor, and/or an air pressure sensor.

According to the embodiment, the brightness of the display panel 30 may be controlled in accordance with the change in external illuminance measured by the illuminance sensor 50.

Figure 2:
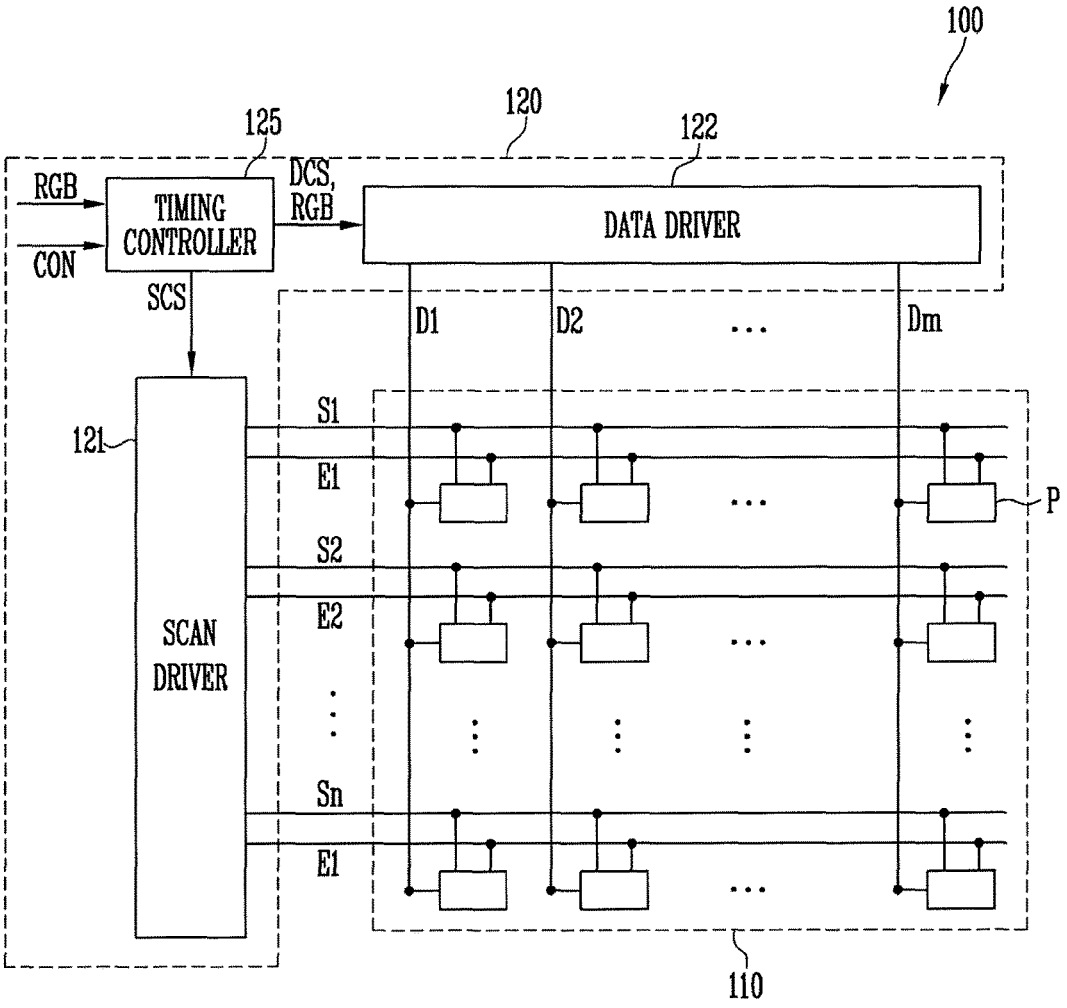
FIG. 2 illustrates an embodiment of a display unit of the display device.

FIG. 2 illustrates an embodiment of a display unit 100 of the display device 1. Referring to FIG. 2, the display unit 100 includes a display driver 120 and a display panel 110. The display driver 120 may include a scan driver 121, a data driver 122, and a timing controller 125. The display panel 30 may be a part of the display panel 110.

The display panel 110 may include a plurality of data lines D1 to Dm, a plurality of scan lines S1 to Sn, a plurality of emission control lines E1 to En, and a plurality of pixels P (n and m are natural numbers of no less than 2). The plurality of scan lines S1 to Sn and the plurality of emission control lines E1 to En extend in a horizontal direction and the plurality of data lines D1 to Dm intersect the plurality of scan lines S1 to Sn and may extend in a vertical direction.

The plurality of pixels P may be connected to the plurality of data lines D1 to Dm, the plurality of scan lines S1 to Sn, and the plurality of emission control lines E1 to En. The pixels P may be arranged in a matrix at intersections of the data lines D1 to Dm and the scan lines S1 to Sn or the emission control lines E1 to En. The pixels P respectively receive data signals, scan signals, and emission control signals through the data lines D1 to Dm, the scan lines S1 to Sn, and the emission control lines E1 to En.

Each pixel P may receive a first power source voltage and a second power source voltage from a power source supplying unit and generates light corresponding to a data signal based on current flowing from the first power source to the second power source via an organic light emitting diode (OLED).

The display driver 120 may include the scan driver 121, the data driver 122, and the timing controller 125. The scan driver 121 generates scan signals in response to a scan driving control signal SCS from the timing controller 125. The scan signals are supplied to the scan lines S1 to Sn. In addition, the scan driver 121 generates emission control signals under control of the timing controller 125. The emission control signals are supplied to the emission control lines E1 to En. The scan driver 121 may be electrically connected to the scan lines S1 to Sn of the display panel 110 through an additional element or may be directly mounted on the display panel 110.

In FIG. 2, it is illustrated that the scan driver 121 is connected to the scan lines S1 to Sn and the emission control lines E1 to En. In another embodiment, the emission control lines E1 to En may be connected to an additional driver to receive emission control signals. Also, in FIG. 2, n scan lines S1 to Sn and n emission control lines E1 to En are illustrated. In one embodiment, at least one dummy scan line and emission control line may be included based, for example, on the structure of the pixel P. Also, in one embodiment, each pixel may be additionally connected to a scan line and an emission control line positioned in a prior or posterior horizontal line in response to a circuit structure.

The data driver 122 receives a data timing control signal DCS and image data RGB from the timing controller 125 to generate data signals. The data signals may be supplied to the data lines D1 to Dm. The data driver 122 may be electrically connected to the data lines D1 to Dm on the display panel 110 through an additional element or may be directly mounted on the display panel 110.

Also, in FIG. 2, the scan driver 121, the data driver 122, and the timing controller 125 are illustrated as being separate from each other. However, in one embodiment, at least some of the elements may be integrated with each other.

The timing controller 125 may receive the image data RGB and a control signal CON that are transmitted, for example, from an external source. The control signal CON may include a horizontal synchronizing signal, a vertical synchronizing signal, and a clock signal.

The timing controller 125 generates the data timing control signal DCS based on the horizontal synchronizing signal and may output the generated data timing control signal DCS to the data driver 122. In addition, the timing controller 125 generates a scan driving control signal SCS based on the vertical synchronizing signal and may output the generated scan driving control signal SCS to the scan driver 121.

In one embodiment, at least one of the image data RGB or the control signal CON transmitted to the timing controller 125 may include information in consideration of a change in the external illuminance around the display device. For example, when the change in external illuminance is sensed by the illuminance sensor 50, a display controller outputs the image data RGB or the control signal CON including the information in consideration of the change in external illuminance. The output image data RGB or control signal CON may be transmitted to the timing controller 125.

Figure 3:
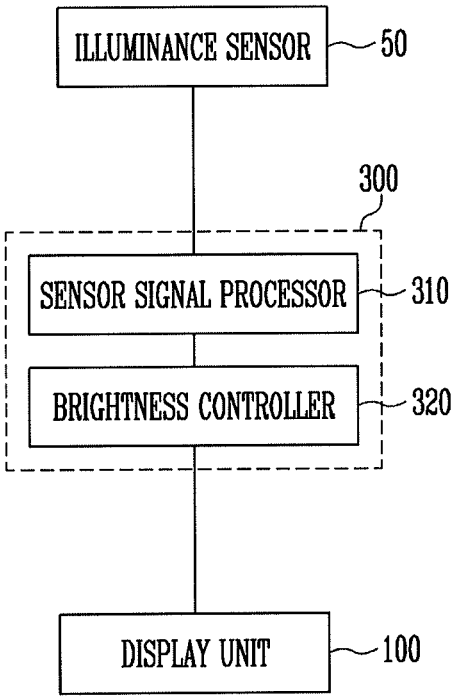
FIG. 3 illustrates an embodiment of the internal structure of the display device.

FIG. 3 illustrates an embodiment of an internal configuration of the display device 1 which includes a display controller 300. Referring to FIG. 3, the display controller 300 includes a sensor signal processor 310 and a brightness controller 320. The display controller 300 may receive a signal including information corresponding to illuminance around the display device 1 from the illuminance sensor 50.

The illuminance sensor 50 measures the illuminance around the display device 1, for example, every uniform period and senses whether the state of illuminance around the display device 1 changes. The illuminance sensor 50 may transmit a measurement result to the display controller 300 whenever the illuminance around the display device 1 is measured. Additionally, or alternatively, after the illuminance around the display device 1 changes and after the changed illuminance is maintained for a predetermined, reliable time, the display controller 300 may transmit the changed illuminance information to the display controller 300.

The illuminance sensor 50 may be, for example, a photo sensor including a photo sensing element such as a transistor or a photodiode. In the photo sensing element, since a resistance value changes in accordance with the amount of light, the external illuminance may be recognized based on a change in the resistance value.

The sensor signal processor 310 may calculate the illuminance around the display device 1 based on the signal obtained by the illuminance sensor 50. The sensor signal processor 310 may output the calculated illuminance value to the brightness controller 320.

The brightness controller 320 may determine to which illuminance value the user belongs with reference to the illuminance value from the sensor signal processor 310. When it is determined that the illuminance value calculated by the sensor signal processor 310 is in a first region, the brightness controller 320 may perform control so that at least one of the pixels P in the display panel 110 is turned off.

In accordance with one embodiment, the off state of the pixel P may correspond to when pixel P does not emit light. Also, the ratio of the number of pixels that emit light components to the number of all pixels in the display panel 110 may be referred to as an on-pixel ratio (OPR). When the measured illuminance value is in the first region, the brightness controller 320 may perform control so that the OPR of the display panel 110 is reduced.

In one embodiment, the first region may be a mesopic region. A mesopic region may be an intermediate region between a scotopic region and a photopic region. In one embodiment, the mesopic region may be an illuminance region corresponding to a brightness level of several $10^{-2}$ cd/m$^2$ to several cd/m$^2$. The mesopic region may correspond to a different range of values in another embodiment.

When the user uses the display device 1 in a dark environment (e.g., a dark room or outside during a full moon), a predetermined reference value corresponding to the first region may be set at the brightness level of several $10^{-2}$ cd/m$^2$ to several cd/m$^{2'}$ to thereby reduce the OPR and brightness of the display panel 110.

For example, an illuminance region corresponding to the brightness level of several $10^{-2}$ cd/m$^2$ to several cd/m$^2$ may be set as the first region. In this case, the brightness controller 320 determines whether the illuminance value calculated by the sensor signal processor 310 is in the first region. When it is determined that the illuminance around the display device 1 is in the first region, the brightness controller 320 may output a predetermined brightness control signal to the display unit 100 to reduce the OPR of the display panel 110.

The predetermined brightness control signal may include information indicative of the pixels P (or the type of pixels P) to be turned off, among the pixels P in the display panel 110, and a ratio of the pixels P to be turned off to the pixels P in the display panel 110. The predetermined brightness control signal may be in at least one of the image data RGB and the control signal CON supplied to the timing controller 125.

When the predetermined brightness control signal is received from the brightness controller 320, the timing controller 125 may transmit the image data RGB, the data timing control signal DCS, and the scan driving control signal SCS generated with reference to the information in the predetermined brightness control signal to the data driver 122 and the scan driver 121. Therefore, some of the pixels P may be turned off by the data signals or the emission control signals input to the pixels P.

In one embodiment, the display panel 110 may include the pixels P that emit different light components. For example, the display panel 110 may include a plurality of first pixels that emit red light components, a plurality of second pixels that emit blue light components, and a plurality of third pixels that emit green light components. In another embodiment, the first to third pixels may emit different light components, e.g., yellow, cyan, and magenta light or a mixed color of the above basic colors or white.

Figure 4:
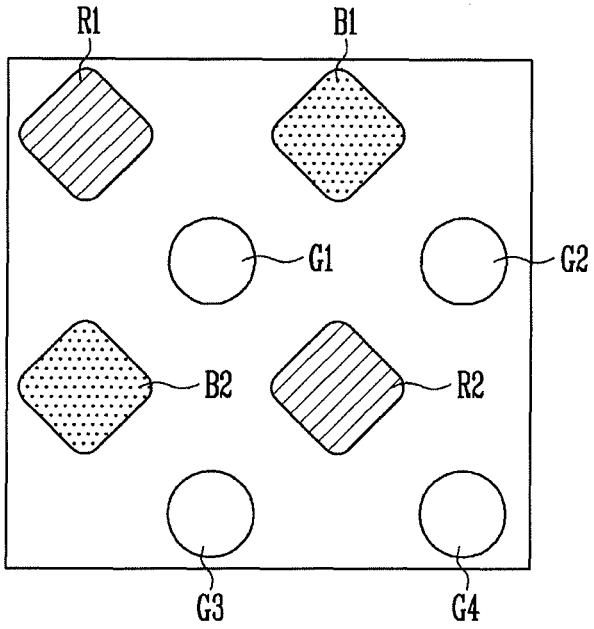
FIG. 4 illustrates an example of a state in which the display device emits light when the display device is driven with an on-pixel ratio (OPR) of 100%.

FIG. 4 illustrates an example of a state in which a pixel P emits light when a display panel is driven with an on-pixel ratio (OPR) of 100%. As described above, the pixels P in the display panel may include pixels that emit different colors of light. For illustrative purposes, it is assumed that the pixels P include first pixels that emit red light components, second pixels that emit blue light components, and third pixels that emit green light components.

Referring to FIG. 4, a predetermined region of the display panel 110 includes first pixels R1 and R2 emitting red light components, second pixels B1 and B2 emitting blue light components, and third pixels G1 to G4 emitting the green light components. When the illuminance around the display device 1 is not in the first region, as illustrated in FIG. 4, all of the pixels R1, R2, B1, B2, and G1 to G4 may generate the light components. When it is determined by the brightness controller 320 that the illuminance around the display device 1 is in the first region, as illustrated in FIG. 5, some of the pixels may be turned off.

Figure 5:
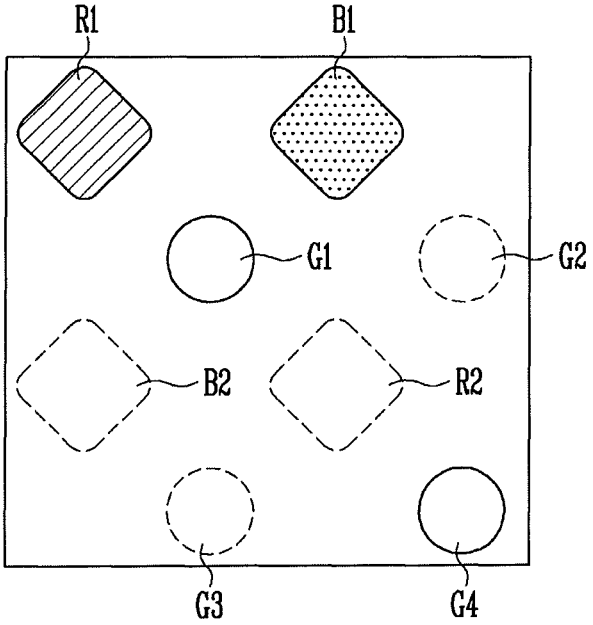
FIG. 5 illustrates an example of a state in which the display device emits light with ultralow brightness.

FIG. 5 illustrates an example of a state in which a display panel emits light with ultralow brightness. FIG. 5 illustrates the same region as the predetermined region of FIG. 4. Referring to FIG. 5, some of the pixels in the predetermined region may be turned off in accordance with the control of the brightness controller 320.

The first pixel corresponding to the reference numeral R1, the second pixel corresponding to the reference numeral B1, and the third pixel corresponding to the reference numerals G1 and G4 are in on states. The first pixel corresponding to the reference numeral R2, the second pixel corresponding to the reference numeral B2, and the third pixels corresponding to the reference numerals G2 and G3 are turned off Since the four pixels R2, B2, G2, and G3 among the eight pixels R1, R2, B1, B2, and G1 to G4 are turned off, the OPR of the display panel 110 may be 50%.

When some pixels are turned off by the brightness controller 320 for low brightness driving, as illustrated in FIG. 5, the first to third pixels may be controlled to be turned off in the same ratio. For example, when 50% of all the pixels are turned off, 50% of the first pixels, 50% of the second pixels, and 50% of the third pixels may be turned off.

According to another embodiment, when the pixels that emit different colors are provided as described above, the OPR of pixels that emit light components of a color with higher brightness may be controlled to be lower. For example, when the first pixels for emitting red light components, the second pixels for emitting blue light components, and the third pixels for emitting green light components are provided in the display panel 110, while 50% of the third pixels are controlled to be turned off, 75% of the first and second pixels may be controlled to be turned off. For example, when four first pixels, four second pixels, and eight third pixels are in the display panel 110, three among the four first pixels, three among the four second pixels, and four among the eight third pixels are controlled to be turned off so that brightness of the display panel 100 may be reduced.

In one embodiment, the pixels P may be turned off in a predetermined ratio when the illuminance around the display device 1 is in the first region.

In another embodiment, when the illuminance around the display device 1 is in the first region, some pixels P may be controlled to be turned off and the OPR of the pixels P may be controlled to vary in accordance with an illuminance value measured by the illuminance sensor 50. For example, as the measured illuminance value is closer to a minimum (or other predetermined) value of the first region, the OPR value is controlled to be smaller. As the measured illuminance value is closer to a maximum (or another predetermined) value of the first region, the OPR value may be controlled to be larger. Therefore, when the user is in a darker environment, the display device 1 may be controlled to be driven with ultralow brightness.

In one embodiment, a storage unit of the display device 1 may store information on a reference value by which the first region is set, the measured illuminance value, and a brightness table in which the OPR applied to the measured illuminance value is mapped.

In one type of display device, the brightness of the display panel 110 is automatically controlled in accordance with external illuminance is applied to the display device. Therefore, when the external illuminance increases, the brightness value of the display panel increases. When the external illuminance is reduced, the brightness value of the display panel may be reduced. However, since each of the pixels P emits light with low brightness, it is difficult to implement ultralow brightness operation.

For example, in a darker environment, the area of the pupils of a person's eyes increases in order to sense a larger amount of light. As the area of the pupils increases, the amount of incident light increases. As a result, eye fatigue increases. For example, when the display device is used in the dark environment such as the dark interior of a room, the degree of fatigue of the user's eyes may increase. In one particular case, since the amount of change in the area of the pupils in accordance with a change in brightness is very large, the degree of fatigue of the user's eyes may be doubled.

In accordance with one or more embodiments, the display panel 110 may be driven with ultralow brightness in accordance with the external illuminance. Thus, the user does not experience increased eye fatigue or otherwise feel tired in the dark environment such as the dark interior of a room.

When brightness of an object that the eyes see is referred to as L and the area of the pupils is referred to as S, retinal illuminance may be defined by a value proportional to multiplication of L and S. On the other hand, Troland (Td) is mainly used as a unit of the retinal illuminance. 1[Td] may be the retinal illuminance when a light source of unit brightness (brightness of 1 cd/m$^2$ or 1 nit) is seen by the pupils having the area of 1 mm$^2$.

According to one embodiment, the degree of fatigue of the eyes of the user may be reduced by reducing a value A in Equation 1.

$$A[Td]=L(cd/m^2)\times S(mm^2) \quad (1)$$

Thus, according to one embodiment, when the user uses the display device 1 in a dark environment without significant lighting, the display device 1 is controlled to be driven with ultralow brightness. It is therefore possible to reduce illuminance of light incident on the pupils and to reduce an amount of change in the area of the pupils. Therefore, it is possible to reduce the degree of fatigue of the eyes of the user when the user uses the display device 1 in the dark environment.

Comparative Example and Embodiment 1

In a comparative example, when a full white screen is displayed on a display panel with a brightness value of 325.8 nit, and when the brightness of the display panel is measured after control is performed so that brightness of each pixel is halved without an additional pixel off operation, the measured brightness value may be about 2 nit.

In contrast, when the brightness of the display panel according to one or more of the aforementioned embodiments is measured after some pixels are turned off, the OPR of the first pixels and the second pixels may be 25% and the OPR of the third pixels may be 50%. As a result, the measured brightness value may be about 0.5 nit. In addition, when some pixels are turned off so that all the first to third pixels have the OPR of 25%, the display panel may emit light with brightness of about 0.4 nit.

Comparative Example and Embodiment 2

In a comparative example, when a full white screen is displayed on a display panel with a brightness value of 241.1 nit, and when the brightness of the display panel is measured after control is performed so that brightness of each pixel is halved without an additional pixel off operation, the measured brightness value may be about 15 nit.

In contrast, when the brightness of the display panel in accordance with one or more of the aforementioned embodiments is measured after some pixels are turned off, the OPR of the first pixels and the second pixels may be 25% and the OPR of the third pixels may be 50%. As a result, the measured brightness value may be about 3.5 nit. When some pixels are turned off so that all the first to third pixels have the OPR of 25%, the display panel may emit light with brightness of about 3.4 nit.

In the above cases, the display panel in accordance with the embodiments may be driven with ultralow brightness in comparison with the comparative examples. Also, when a user uses the display device of the embodiments in the dark environment, it may be sensed and the display panel 110 may be controlled to be driven with ultralow brightness so that the degree of fatigue of the user may be reduced.

Figure 6:
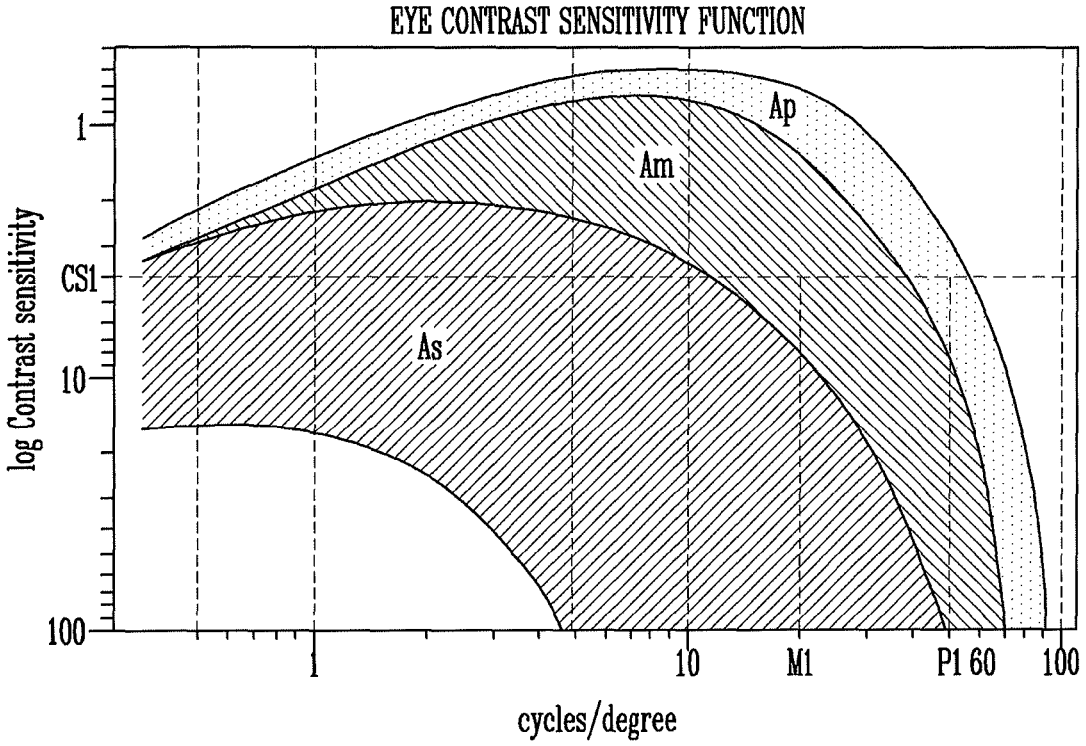
FIG. 6 illustrates an example of a contrast sensitivity function.

FIG. 6 is a graph illustrating an example of a contrast sensitivity function in accordance with one embodiment. The contrast sensitivity function may be expressed as contrast sensitivity (Y axis) versus cycles per degree (X axis). In FIG. 6, the region As represents a scotopic region, the region Am represents a mesopic region (the first region according to one or more embodiments), and the region Ap represents a photopic region.

For the same contrast sensitivity value CS1, a cycles per degree value M1 corresponding to the contrast sensitivity value CS1 in the mesopic region is less than the cycles per degree value P1 corresponding to the contrast sensitivity value CS1 in the photopic region. Thus, the resolution that may be recognized by a person deteriorates in a low brightness environment.

Therefore, when the user uses the display device 1 in an environment that corresponds to the mesopic region, the display panel 110 is controlled to be driven with ultralow brightness. Thus, it is possible to reduce the degree of eye fatigue of the user and to prevent resolution from deteriorating in accordance with low brightness of the display panel 110.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, controller, or other signal processing device which is to execute the code or instructions for performing the method embodiments described herein.

The controllers, processors, and other processing features of the embodiments disclosed herein may be implemented in logic which, for example, may include hardware, software, or both. When implemented at least partially in hardware, the controllers, processors, and other processing features may be, for example, any one of a variety of integrated circuits including but not limited to an application-specific integrated circuit, a field-programmable gate array, a combination of logic gates, a system-on-chip, a microprocessor, or another type of processing or control circuit When implemented in at least partially in software, the controllers, processors, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

The foregoing discussion describes a method for controlling the brightness of ae display panel when the illuminance value measured by an illuminance sensor is in the first region. However, in other proposed methods, when the measured illuminance value is in the photopic region (second region), the brightness of the display panel 110 may be automatically controlled. Thus, when the measured illuminance value is in the second region, the brightness of each pixel is controlled so that the display panel emits light with high brightness when the measured illuminance value is large and is controlled to emit light with low brightness when the measured illuminance value is small.

In one or more embodiments, the display device 1 may be included in a portable terminal, e.g., a mobile phone, a smart phone, a tablet PC, a hand-held PC, a portable multimedia player (PMP), a personal digital assistant (PDA), or a TV set.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the embodiments set forth in the claims.

What is claimed is:

1. A display device, comprising:

a display panel including a plurality of pixels;

an illuminance sensor to measure illuminance; and a display controller including a processor to calculate an external illuminance value with reference to a signal from the illuminance sensor and a brightness controller to turn off at least one of the pixels and to control brightness of the display panel when the calculated external illuminance value is in a first region, wherein the brightness controller is to control on and off states of each of the pixels so that a ratio of a number of turned on pixels to a number of all pixels in the display panel is a predetermined value when the external illuminance value is in the first region.

2. The display device as claimed in claim 1, wherein the first region is in a mesopic region.

3. The display device as claimed in claim 1, wherein the brightness controller is to control the on and off states of each of the pixels when the external illuminance value is in the first region and is to control on and off states of the pixels to reduce the ratio of the number of turned on pixels to the number of all pixels in the display panel as the external illuminance value decreases.

4. The display device as claimed in claim 1, wherein:

the pixels include first pixels, second pixels, and third pixels to emit light components of different colors, and a ratio of a number of turned on first pixels to a number of all first pixels in the display panel, a ratio of a number of turned on second pixels to a number of all second pixels in the display panel, and a ratio of a number of turned on third pixels to a number of all third pixels in the display panel are substantially equal.

5. The display device as claimed in claim 1, wherein:

the pixels include first pixels to emit light components of a first color, second pixels to emit light components of a second color, and third pixels to emit light components of a third color, and the brightness controller is to perform control so that a ratio of pixels with respect to a color with lowest emission brightness is highest among a ratio of a number of turned on first pixels to a number of all first pixels in the display panel, a ratio of a number of turned on second pixels to a number of all second pixels in the display panel, and a ratio of a number of turned on third pixels to a number of all third pixels in the display panel.

6. The display device as claimed in claim 5, wherein the first color, the second color, and the third color are respectively red, blue. and green, and wherein a ratio of the number of turned on third pixels to the number of all third pixels in the display panel is highest.

7. A method for controlling a display device, the method comprising:

measuring illuminance using an illuminance sensor;

calculating an external illuminance value with reference to a signal from the illuminance sensor;

determining whether the external illuminance value is in a first region; and turning off at least one of a plurality of pixels in a display panel to control brightness of the display panel when the external illuminance value is in the first region, wherein controlling the brightness of the display panel is performed by controlling on and off states of each of the pixels so that a ratio of a number of turned on pixels to a number of all pixels in the display panel is a predetermined value.

8. The method as claimed in claim 7, wherein the first region is in a mesopic region.

9. The method as claimed in claim 7, wherein controlling the brightness of the display panel is performed by controlling the on and off states of each of the pixels when the external illuminance value is in the first region and controlling on and off states of each of the pixels to reduce the ratio of the number of turned on pixels to the number of all pixels in the display panel s the external illuminance value decreases.

10. The method as claimed in claim 7, wherein:

the pixels include first pixels, second pixels, and third pixels to emit light components of different colors of light, and a ratio of a number of turned on first pixels to a number of all first pixels in the display panel, a ratio of a number of turned on second pixels to a number of all second pixels in the display panel, and a ratio of a number of turned on third pixels to a number of all third pixels in the display panel are substantially equal.

11. An apparatus, comprising:

a processor to calculate an external illuminance value with reference to a signal from an illuminance sensor; and a brightness controller to turn off at least one of a plurality of pixels to control brightness of a display when the external illuminance value is in a first region, wherein the brightness controller is to control on and off states of each of the pixels so that a ratio of a number of turned on pixels to a number of all pixels in the display is a predetermined value when the external illuminance value is in the first region.

12. The apparatus as claimed in claim 11, wherein the first region is in a mesopic region.

13. The apparatus as claimed in claim 11, wherein the brightness controller is to control the on and off states of each of the pixels when the external illuminance value is in the first region and is to control on and off states of the pixels to reduce the ratio of the number of turned on pixels to the number of all pixels in the display as the external illuminance value decreases.

14. The apparatus as claimed in claim 11, wherein:

the pixels include first pixels, second pixels, and third pixels to emit light components of different colors, and a ratio of a number of turned on first pixels to a number of all first pixels in the display, a ratio of a number of turned on second pixels to a number of all second pixels in the apparatus, and a ratio of a number of turned on third pixels to a number of all third pixels in the display are substantially equal.

* * * * *